United States Patent [19]

Riba

[11] Patent Number: 5,046,335

[45] Date of Patent: Sep. 10, 1991

[54] TUNNEL FINISHER WITH AIR ROLLERS

[76] Inventor: Gunther Riba, Rosenbergstrasse 26, D-5455 Hardert, Fed. Rep. of Germany

[21] Appl. No.: 657,276

[22] Filed: Feb. 19, 1991

Related U.S. Application Data

[63] Continuation of Ser. No. 328,224, Feb. 14, 1989, abandoned.

[30] Foreign Application Priority Data

Jun. 22, 1987 [DE] Fed. Rep. of Germany ..... 3720581

[51] Int. Cl.[5] ..... D06F 61/06; D06B 3/30; D06B 23/02; D06B 23/18

[52] U.S. Cl. ..... 68/5 C; 38/14; 38/49; 68/5 E

[58] Field of Search ..... 68/5 C, 5 E; 38/1 A, 38/8, 9, 14, 44, 49; 226/194; 29/110, 110.5, 129.5, 426.1, 426.5; 198/624; 100/159

[56] References Cited

U.S. PATENT DOCUMENTS 3,485,618 12/1969 Ritter, Jr. ..... 29/110 X
3,978,974 9/1976 Morrissey et al. ..... 29/110 X

*Primary Examiner*—Philip R. Coe
*Attorney, Agent, or Firm*—Donald Brown; David S. Resnick

[57] ABSTRACT

It shall be achieved to design tunnel finishers with air rollers such that the replacement of the jackets of the air rollers is easily possible, even if the air rollers are arranged in the interior of a housing.

In order to achieve this object the air roller is supported such that the axis (19) may be removed from one of the two bearings therefore such that the jacket (35) can be replaced via the removed free end.

Such tunnel finishers can in particular be used in the clothing industry.

8 Claims, 2 Drawing Sheets

TUNNEL FINISHER WITH AIR ROLLERS

This is a continuation of copending application Ser. No. 07/328,224 filed on Feb. 14, 1989, and now abandoned.

The invention refers to a tunnel finisher with air rollers for restricting the inlet or outlet, respectively, of a clothing processing area of the tunnel finisher, the air rollers having a substantially cylindrical envelope-shaped jacket having a bottom and top region and a bottom and top disk arranged in the respective region of the jacket, the jacket being placed around the edges of the disks, and an axis between both disks, the axis extending in substantially vertical direction and having its upper end supported in an upper bearing and its lower end supported in a lower bearing.

Such a tunnel finisher with air rollers is known from the DE-PS 35 19 568. In the known solution the axis for inserting or removing, resp., the jacket is formed to be separable. The tunnel finisher comprises a housing which includes a steam chamber in a first part thereof and a finishing chamber in a second part thereof connected with the first part. The replacement of the known air rollers is difficult in that, after replacement of the jacket, the length of the axes must be accurately aligned. Moreover, it is necessary, for replacement of the air rollers between steam chamber and finishing chamber, to detach the whole housing such that a direct access to the portion containing the air rollers therebetween is possible.

It is the object of the invention to design the air rollers such that the replacement is simplified. It shall in particular be possible to replace the air rollers between steam chamber and finishing chamber without dismounting the housing.

This object is achieved by a tunnel finisher with air rollers having the features of for restricting the inlet or outlet, respectively, of a clothing processing area of the tunnel finisher, the air rollers having a substantially cylindrical envelope-shaped jacket having a bottom and top region and a bottom and top disk, arranged in the respective region of the jacket, the jacket being placed around the edges of the disks, and an axis between both disks, the axis extending in substantially vertical direction and having its upper end supported in an upper bearing and its lower end supported in a lower bearing, wherein the improvement comprises a flexible section in a region between both disks of the axis, further comprising means for supporting the air rollers so that one end of the axis can be removed from the corresponding bearings permitting the jacket to be replaced via removed free end.

Further embodiments of the invention are characterized in which the flexible section is formed by a chain; the upper end of the axis is removable from the bearing for replacing the jacket; the axis is adapted to be connected with pulling means for lifting the axis; the axis is connected with drive means through a friction clutch.

The features of the invention will stand out from the description of embodiments with respect to the Figures. In the Figures.

Figure 1:
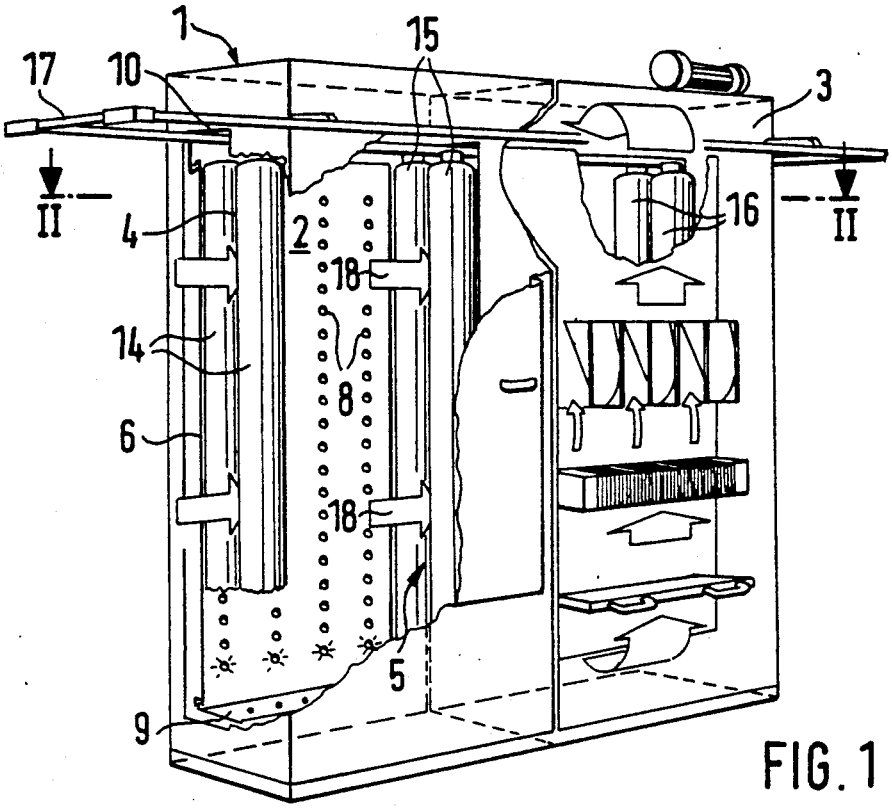
FIG. 1 is a perspective representation of the tunnel finisher with partly removed lateral walls.
Figure 2:
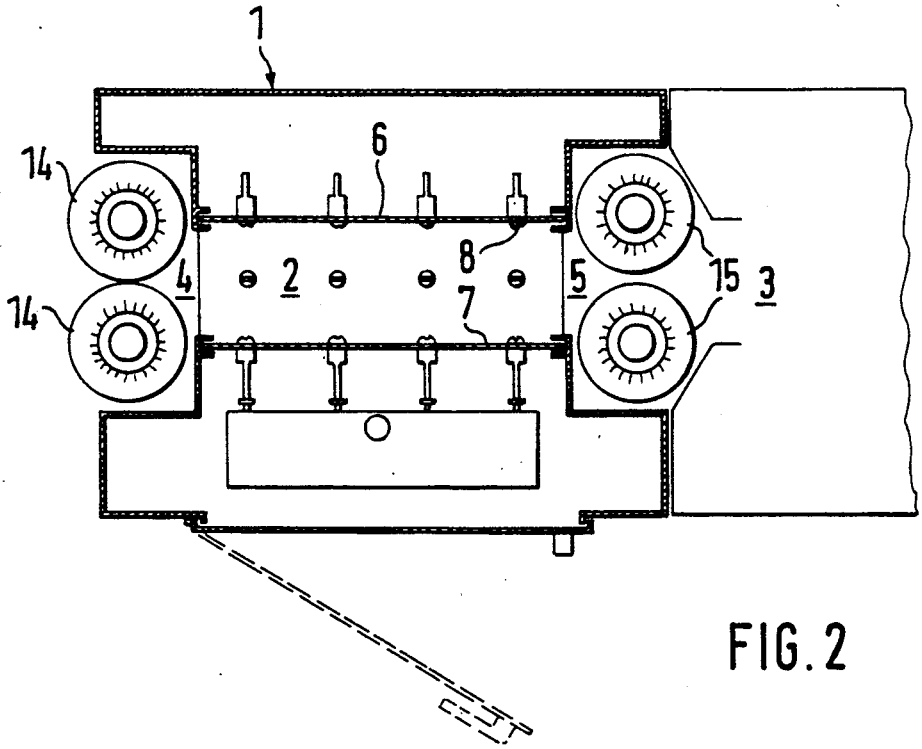
FIG. 2 is a section along line II—II of the steam chamber.

The tunnel finisher comprises an elongate housing 1 consisting of two parts. The first part includes a steam chamber 2 and the second part a finishing chamber 3. Both parts are connected with each other in a rigid, but separable manner.

The steam chamber 2 comprises, at one of the small faces of the housing, an inlet opening 4 and at the opposite end thereof an outlet opening 5 towards the finishing chamber 3. The lateral walls of the steam chamber 2 are formed by vertical walls 6, 7 which comprise a large number of steam nozzles 8 distributed over the whole area of the vertical walls. The bottom 9 and the ceiling plate 10 comprise steam nozzoles as well.

Respective pairs of air rollers or drums 14, 15, 16 are provided at the inlet opening 4, at the outlet opening 5 and positioned at the boundary between steam chamber and finishing chamber and thus in the interior of the housing, and at the outlet of the finishing chamber 3. A chain conveyor 17 is arranged at the upper end of both chambers. Pieces of clothing to be processed or treated are hung up to the chain conveyor and passed through the air rollers 14, 15 and the chambers 2, 3 in the manner indicated by the arrows 18.

The air rollers comprise a respective axis 19 which is supported in bearings 20, 21 mounted to the housing 1 or the bottom 9 of the tunnel finisher, resp. A vertically positioned guide tube 22 is supported in the upper bearing 20. The upper end or the guide tube is rigidly connected with a horizontal plate 23 and the lower end is rigidly connected with a sprocket wheel 24. The guide tube 22 receives the axis 19. The axis 19 has a first rigid section 25 and a second rigid section 26. The two rigid sections are connected with each other through a flexible section 27. The flexible section is designed such that the distance between the tow rigid sections remains constant and a torque acting upon the of the rigid sections is transferred to the respective other rigid section, i.e. that both sections rotate simultaneously. In the embodiment shown in FIG. 3 the flexible section consists of a link chain having its respective last links connected to the respective adjacent rigid sections.

The axis 19 extends through the guide tube 22. The upper for end 28 of the axis projects upwards out of the guide tube beyond the plate 23 and is rigidly connected with a weight 30 through a fixing bolt 29 in an adjustable manner.

Figure 3:
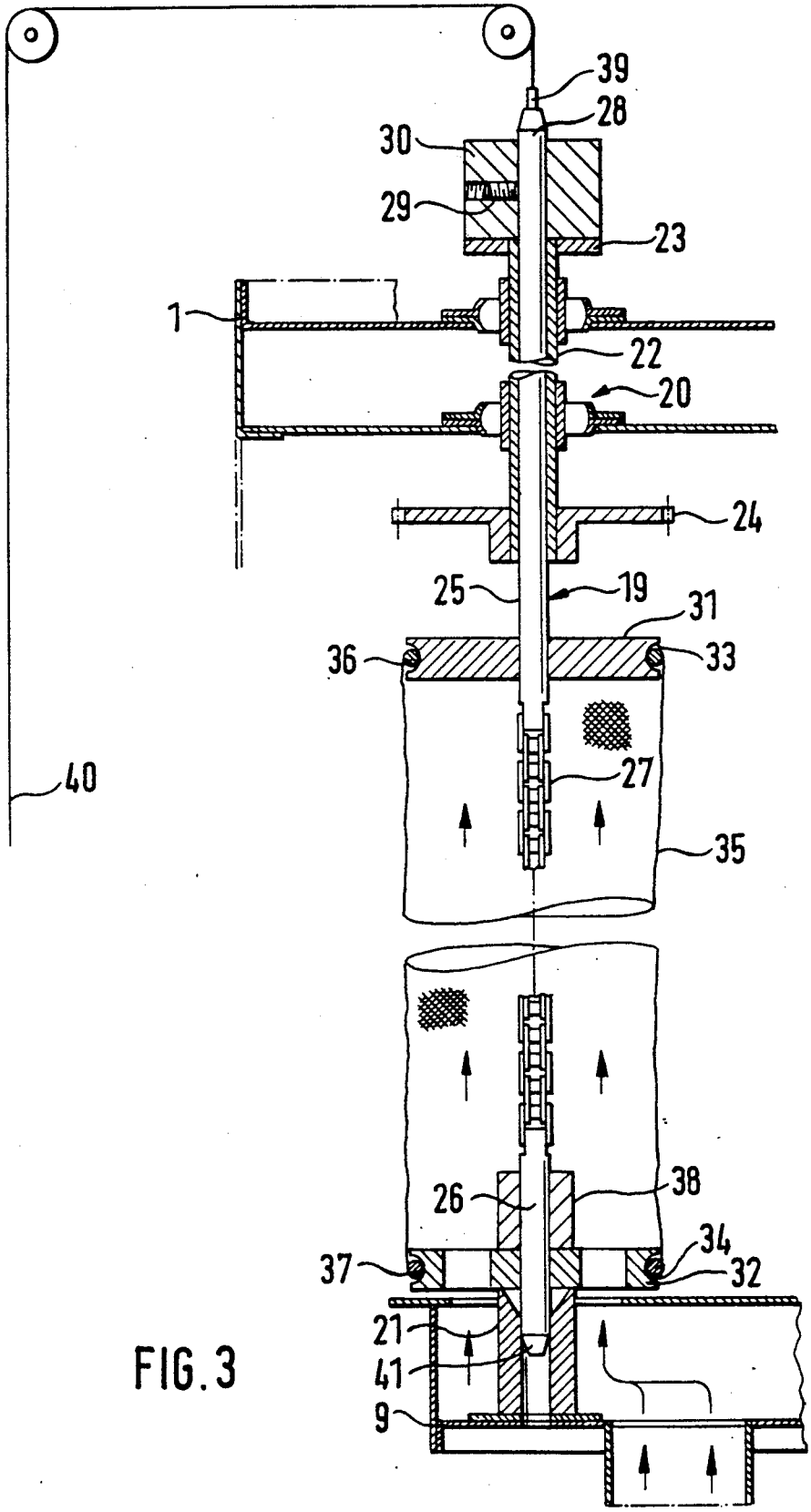
FIG. 3 is a section through the air roller.

A disk 31 is fixed to the first section 25 of the axis. A respective circular disk 32 is provided at the second rigid section 26. Both disks have a respective annular groove 33, 34 on the preiphery thereof. Furthermore, a substantially cylindrical jacket 35 is provided as an envelope which has respective margins at the upper and lower edge thereof which receive a respective annular spring 36, 37. The jacket is stretched by inserting the annular springs into the annular grooves of the disks. The lower disk is formed in known manner as a punched disk such that air can be blown into the air roller. Right above the lower disk 32 a further weight 38 is attached around the rigid section 26. The lower bearing 21 is arranged coaxially with the guide tube 22. The opening facing the guide tube 22 is funnel-shaped in the manner shown in FIG. 3. Moreover, the end of the rigid section 26 facing the bearing is tapered as shown in FIG. 3.

The sprocket wheel 24 is connected with a drive through a respective chain. In the operating position shown in FIG. 3 the air rollers are driven by driving the sprocket wheel 24. The rotating movement of the sprocket wheel is transmitted to the disk 23 through the guide tube 22 and therefrom to the weight 30 and thus the axis 19 through the friction clutch formed by the weight 30. Thanks to the rotationally stable connection between the two rigid sections of the axis both sections rotate to the same extent.

Whenever the jacket or coat of the air roller shall be replaced, the free end 28 of the axis 19 is connected with a traction rope 40 through a mount 39 provided therefore. The connection of weight 30 and axis 19 is undone by detaching the fixing bolt 29. The axis 19 and thus also the air roller connected thereto is lifted by means of the traction rope 40 to such an extend that the lower end 41 of the axis 19 has emerged from the bearing 21. Then the lower end of the air roller is gripped, for example, with a hook. At the same time the first rigid section 25 is lowered by loosening the traction rope 40 to such an extent that it downwardly energes from the guide tube 22. Thereupon the air roller can be removed from the housing by means of the hook-shaped gripping tool. The replacement of the jacket is performed outside of the housing by sliding the jacket off across the lower end and replacing it by a new jacket. After the replacement the first rigid section is drawn by means of the traction rope 40 first towards the guide tube 22 and thereupon into the same upwards to such an extent that the lower end 41 due to its own weight arrives within the funnel-shaped opening of the bearing 21 forming a guide. Subsequently the connection of the weight 30 with the axis through the fixing bolt 29 is reinstalled and thereafter the traction rope 40 is detached such that the air roller rests on the plate 23 with its own weight and the weight 30 and forms the described friction clutch.

It is therefore essential that the air roller can be lifted by such an extend that the lower end 41 of the axis 19 emerges from the lower bearing 21 and the air roller can be passed out of the housing by simultaneously easing away the traction rope 40.

When reinserting the air roller after a replacement operation the previously lifted air roller can be lowered to such an extent that the lower disk 32 rests upon the bearing 21. Thereafter the traction rope 40 is pulled to such an extent that the jacket of the air roller is stretched. In this position the fixing bolt 29 is tightened and subsequently the traction rope 40 may be unscrewed.

In the above-described embodiment the flaxible section is formed by a link chain. this section may, however, be formed by other members which, on the one hand, connect the two sections 25 and 26 in a rotationally stable manner and on the other hand, allow the bending around an axis which does not coincide with the axis 19.

I claim:

1. A tunnel finisher with air rollers for restricting the inlet or outlet, respectively, of a clothing processing area of the tunnel finisher, the air rollers having a substantially cylindrical envelop-shaped jacket having a bottom and top region and a bottom and top disk arranged in the respective region of the jacket, the jacket being placed around the edges of the disks, and an axis between both disks, the axis extending in substantially vertical direction and having its upper end supported in an upper bearing and its lower end supported in a lower bearing, further comprising means for supporting the air rollers and a flexible non-rigid section in a region between both disks of the axis, so that one end of the axis can be removed from the corresponding bearings permitting the jacket to be replaced via the removed free end.

2. The tunnel finisher according to claim 1,
in which the upper end of the axis is removable from the bearing for replacing the jacket.

3. A tunnel finisher according to claim 1,
in which the axis is adapted to be connected with pulling means for lifting the axis.

4. A tunnel finisher according to claim 1,
in which the axis is connected with drive means through a friction clutch.

5. A tunnel finisher with air rollers for restricting the inlet or outlet, respectively, of a clothing processing area of the tunnel finisher, the air rollers having a substantially cylindrical envelope-shaped jacket having a bottom and top region and a bottom and top disk arranged in the respective region of the jacket, the jacket being placed around the edges of the disks, and an axis between both disks, the axis extending in substantially vertical direction and having its upper end supported in an upper bearing and its lower end supported in a lower bearing, wherein the improvement comprises a flexible chain in a region between both disks of the axis, further comprising means for supporting the air rollers, so that one end of the axis can be removed from the corresponding, bearings permitting the jacket to be replaced via the removed free end.

6. The tunnel finisher according to claim 5,
in which the upper end of the axis is removable from the bearing for replacing the jacket.

7. A tunnel finisher according to claim 5,
in which the axis is adapted to be connected with pulling means for lifting the axis.

8. A tunnel finisher according to claim 5,
in which the axis is connected with drive means through a friction clutch.

* * * * *